United States Patent [19]

Crankshaw et al.

[11] 4,201,621

[45] May 6, 1980

[54] LABEL APPLICATOR FOR IRREGULARLY SHAPED ARTICLES

[75] Inventors: Michael Crankshaw, Santa Fe Springs; Leo Kucheck, Irvine, both of Calif.

[73] Assignee: Label-Aire Inc., Fullerton, Calif.

[21] Appl. No.: 930,720

[22] Filed: Aug. 3, 1978

[51] Int. Cl.[2] ..... B65C 9/02; B65C 9/06; B65C 9/42

[52] U.S. Cl. ..... 156/567; 156/361; 156/364; 156/542; 156/DIG. 25; 156/DIG. 27; 156/DIG. 45

[58] Field of Search ..... 156/458, 493, 542, 567, 156/DIG. 25, DIG. 26, DIG. 27, 568, 361, 364, DIG. 45

[56] References Cited

U.S. PATENT DOCUMENTS

| | | | |
|---|---|---|---|
| 2,668,632 | 2/1954 | Zimpel | 156/493 |
| 2,764,408 | 9/1956 | Weiler | 156/568 |
| 2,936,921 | 5/1960 | Schulz | 156/568 |
| 3,064,714 | 11/1962 | Flood | 156/567 |
| 3,262,832 | 7/1966 | Fairest | 156/568 |
| 3,367,822 | 2/1968 | Hoffler | 156/567 |
| 3,944,455 | 3/1976 | French | 156/361 |
| 4,096,939 | 6/1978 | Riggs et al. | 198/460 |
| 4,129,473 | 12/1978 | Perret | 156/542 |

*Primary Examiner*—Michael G. Wityshyn
*Attorney, Agent, or Firm*—Gordon L. Peterson

[57] ABSTRACT

A label applicator which grips the article to be labeled on the opposite sides of the article to hold the article in a predetermined orientation. One or more labels are applied to the article while it is held in the predetermined orientation. The article is gripped between a movable resilient member and a guide which holds the article against the movable resilient member.

16 Claims, 6 Drawing Figures

LABEL APPLICATOR FOR IRREGULARLY SHAPED ARTICLES

BACKGROUND OF THE INVENTION

In labeling some articles, it is necessary to grip the articles and accurately hold them in a predetermined orientation. This is necessary, for example, in labeling articles, such as bottles, of an irregular configuration with labels which must be accurately oriented on the article.

One prior art way of accomplishing this labeling function is to guide the article into a lead screw with the lead screw rotating at a speed to advance the article at approximately the same rate as the article conveyor. With this arrangement, the article is retained between the threads of the lead screw by a guide. A top hold-down belt holds the article downwardly against the conveyor.

A primary problem with this prior art construction is that a different setup is required for each different size article to be labeled. For example, the lead screw must be changed each time an article of a different length is to be labeled and the height of the hold-down belt must be adjusted each time articles of different height are to be labeled. These changes take time to accomplish and increase the downtime of the labeling line, as well as requiring additional capital outlay and storage space for the different sizes of screws that are necessary.

This prior art construction has other disadvantages. For example, if the article is a bottle with a cap and the cap is inadvertently left off, the top hold-down belt cannot perform its article capturing function due to the reduced overall height of the article as a result of the absence of the cap. In addition, the loading of articles into the screw requires some special consideration, such as a special input device or a jam input. Finally, with the article held by the lead screw, it is sometimes difficult to provide sufficient room while the article is captured to carry out the labeling function.

SUMMARY OF THE INVENTION

This invention solves the problems noted above. For example, with the label applicator of this invention, articles of different sizes and configurations can be labeled with little or no change in the mechanism for holding the articles in a predetermined orientation. The input to the article capturing mechanism is simplified, and variations in height of the article do not affect the ability of the mechanism to capture and retain the articles in a predetermined orientation.

This invention eliminates the lead screw of the prior art. In addition, the need for the hold-down belt is eliminated; however, the hold-down belt can be used if desired.

With this invention, the article gripping means includes first means for engaging the article on at least one side thereof. The first means has a resilient, deformable surface and is mounted for movement. The article gripping means also includes means cooperating with the first means for engaging the articles on at least the other side thereof to urge the articles against the resilient deformable surface. This urges the articles against the resilient, deformable surface to deform the latter. Consequently, pockets are formed in the deformable surface which generally conform to the shape of the article and the cooperating means holds the articles in these pockets. This securely holds the articles in a predetermined orientation so that labeling means can apply labels to the articles while they are held in the predetermined orientation. This assures that the labels will be accurately placed on the articles.

Because the resilient, deformable surface can effectively take the configuration of the article to be labeled, reasonable variations in this configuration do not require any setup change. Because the articles can be retained in a predetermined orientation by gripping them on the opposite sides, the hold-down belt of the prior art is not required. Consequently, variations in height of the articles do not require a change in setup. For major changes in width of the articles, the spacing between the first means and the cooperating means can be quickly and easily adjusted.

Typically, the articles to be labeled are moved past the label applicator on a conveyor. With this invention, the article gripping means can take the articles off of the conveyor while they are held in the predetermined orientation or leave them on the conveyor while they are held in the predetermined orientation. One advantage of taking the articles off of the conveyor is that labeling the bottom of the articles is possible. In addition, more accuracy can be obtained with the articles off line.

Although the first means may take different forms, in a preferred embodiment, it includes a rotatable wheel having a peripheral surface which is resiliently deformable and which is engageable with one side of the article. The resilience of the peripheral surface can be brought about in different ways, such as by constructing the wheel or a portion thereof of resilient material, by using an inflatable bladder for all or a portion of the wheel, etc. Alternatively, a soft belt or one which can be resiliently deformed inwardly can be used. In any event, the peripheral surface can deform to take on the configuration of the article pushed against it.

The wheel is preferably mounted for rotation about a rotational axis which extends generally transverse to the direction of movement of the conveyor adjacent the wheel. The wheel lies at least partially in the path of articles conveyed to the wheel by the conveyor. With the articles being moved horizontally past the label applicator, the rotational axis of the wheel is preferably generally vertical, although other orientations of this axis which would permit the peripheral surface of the wheel to grip a side of the article to be labeled can be employed.

The cooperating means can be any means which urges the articles against the peripheral surface of the wheel. For example, the cooperating means may include a guide for directing the articles appropriately against the wheel and holding the articles against the wheel for a predetermined length of travel of the articles. For example, the guide may include one or more stationary rails, at least a portion of which has a shape complementary to the shape of the peripheral surface of the wheel. Both the peripheral surface of the wheel and the guide may be similarly curved.

To take the articles off the conveyor utilizing the wheel, preferably the wheel is placed in the path of the articles on the conveyor with a portion of the peripheral surface being displaced horizontally from the conveyor. The guide is appropriately shaped to guide the articles on the conveyor against the peripheral surface and then forwardly in the direction of conveyor movement and laterally off of the conveyor generally following the contour of the peripheral surface. If desired, a platform can be provided adjacent the conveyor at the location where the articles are moved laterally off of the conveyor so that the articles can be moved over the platform. To permit bottom labeling, the platform should have aperture means so that the label applicator can apply the label to the bottom of the article through the aperture means.

Although for some applications, it may be possible to rotate the wheel using power from the conveyor applied through the articles to be labeled, it is preferred to provide motor means for rotating the wheel because this enables removal of the articles from the conveyor. In addition, by driving the wheel, and hence the article to be labeled, at a known speed and sensing the article after it is captured, the label can be very accurately placed on the article.

The invention, together with further features and advantages thereof, may best be understood by reference to the following description taken in connection with the accompanying illustrative drawings.

DESCRIPTION OF THE PREFERRED EMBODIMENT

Figure 1:
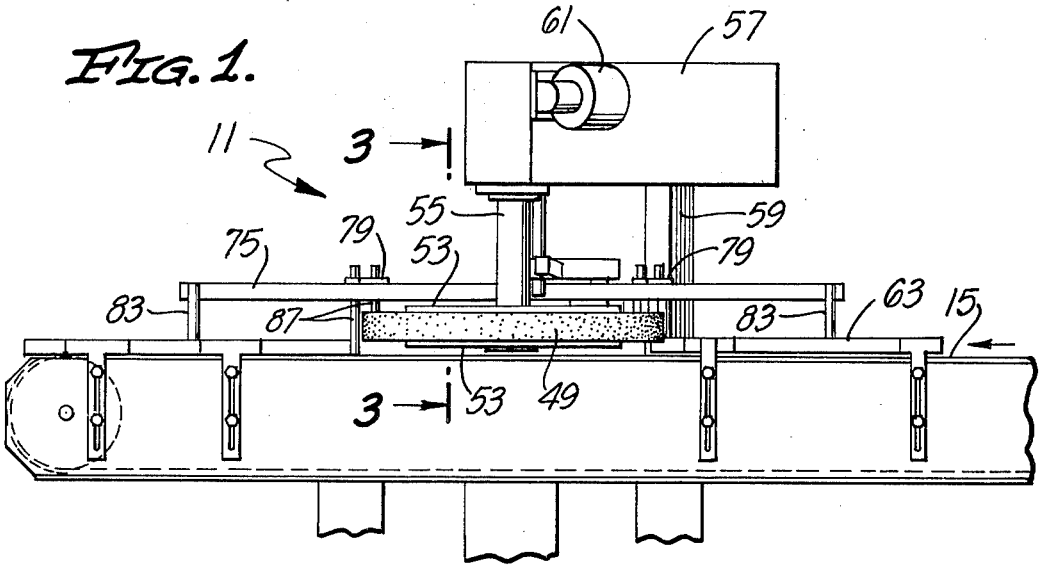
FIG. 1 is a fragmentary side elevational view of a label applicator constructed in accordance with the teachings of this invention and installed adjacent to a conveyor line for labeling the articles on such line.
Figure 2:
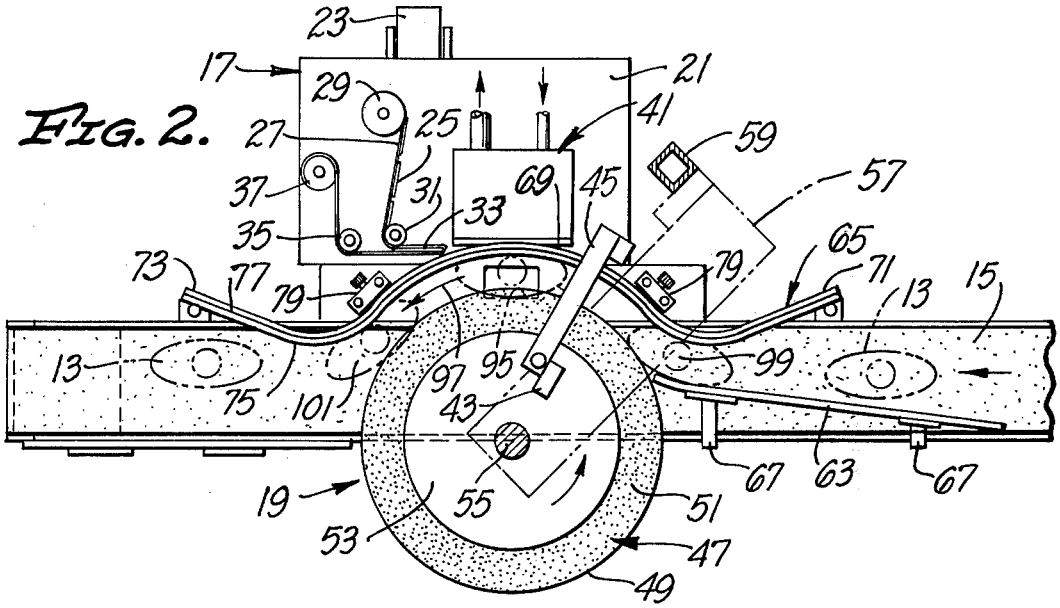
FIG. 2 is a top plan view of the construction shown in FIG. 1.
Figure 3:
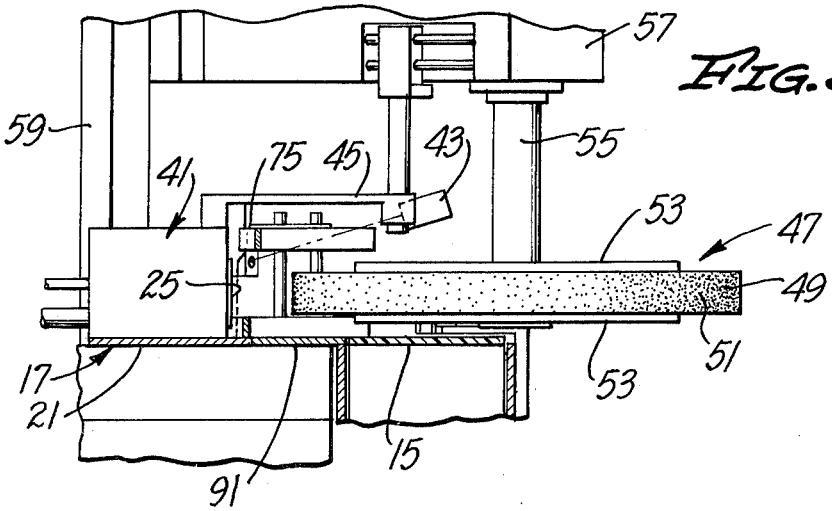
FIG. 3 is an enlarged fragmentary sectional view taken generally along line 3—3 of FIG. 1.
Figure 4:
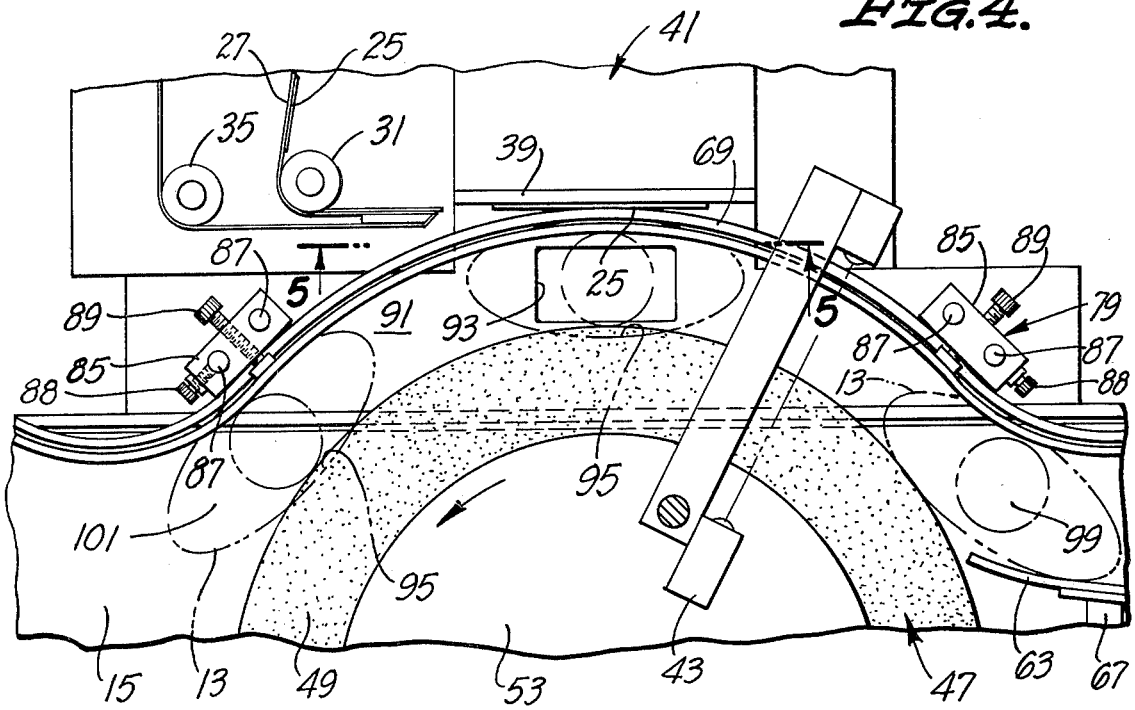
FIG. 4 is an enlarged top plan view of a portion of the construction shown in FIG. 1.

FIGS. 1 and 2 show a label applicator 11 for applying labels to articles 13 (FIG. 2) which are moved along a horizontal path past the label applicator 11 by any suitable means, such as a conveyor 15. The label applicator of this invention is particularly adapted for labeling articles of elliptical, tapered or other irregular configurations; however, it can also be used for labeling articles of more conventional configuration. Generally, the label applicator 11 includes labeling means 17 and article capturing means 19.

The labeling means 17 may be of conventional construction and, for this reason, is not described in detail herein. Briefly, the labeling means 17 includes a supporting structure 21 mounted on a suitable support, such as a vertical post 23 so that its height may be adjusted. The post 23 may, in turn, be mounted on a movable carriage (not shown) to permit the labeling means 17 to be moved horizontally.

Although the labeling means 17 may use various different kinds of label feeds, in the embodiment illustrated, labels 25 are releasably adhered to an elongated backing strip or web 27 by a pressure sensitive adhesive. The web 27 is wound on a supply reel 29 and passes over a plurality of rollers 31 (only one being shown in FIG. 2) to a peeling bar 33 and then over one or more additional rollers 35 to a take-up reel 37. In passing over the peeling bar 33, the web 27 is folded into a reverse bend, and the label 25 is separated from the web.

Figure 5:
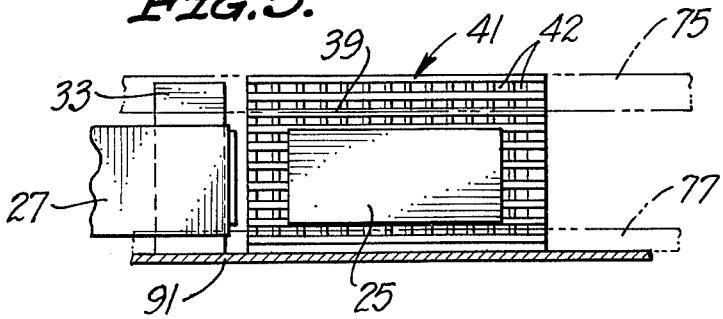
FIG. 5 is an elevational view taken generally along line 5—5 of FIG. 4 with the upper and lower rails being shown in phantom lines.

A label 25 removed from the web 27 is releasably retained at a labeling station. Although this function can be provided for in different ways, in the embodiment illustrated, the removed label is releasably retained in a well-known manner against an air pervious grid 39 by sub-atmospheric pressure within a vacuum box 41. In the embodiment illustrated, the grid 39 lies in a vertical plane and has openings 42 (FIG. 5). The label 25 is retained on the grid until one of the articles 13 is properly positioned with respect thereto, and at this instant, the label is transferred from the grid 39 to such article with the adhesive on the label adhering it to the article. Although this transfer function can be accomplished in different ways, in the embodiment illustrated, a blast of air under pressure is supplied to the vacuum box 41 and through the openings 42 to blow the label 25 onto the article 13 adjacent the grid 39.

The labeling means 17 can be controlled in a known manner. As shown in FIG. 2, a product sensor 43 is carried by an arm 45 of the supporting structure 21 and provides a signal each time the leading edge of one of the articles 13 approaches the grid 39. Thereafter, the labeling means 17 is appropriately timed in a known manner to apply the label to the article 13 when it reaches an appropriate position immediately adjacent the grid 39.

The article capturing means 19 includes a wheel 47 having a cylindrical peripheral surface 49. Although the wheel 47 may be of different constructions, in the embodiment illustrated, it includes a resiliently deformable cylindrical disc 51 of foam plastic material sandwiched between a pair of a circular cover plates 53. The disc 51 is of larger diameter than the plates 53 and so an annular region of the disc projects radially outwardly beyond the plates 53.

The wheel 47 is mounted for rotation about a vertical rotational axis by a shaft 55 which in turn is rotatably mounted on an arm 57. The arm 57 is in turn suitably mounted on a post 59 so that the elevation of the wheel 47 can be adjusted. The post 59 can be mounted on a suitable carriage (not shown) to permit the horizontal position of the wheel 47 to be adjusted. A motor 61 rotates the shaft 55 and the wheel 47.

To control movement of the articles 13 on the conveyor 15 near the wheel 47, guides 63 and 65 are employed. The guide 63 is a lead-in guide and it extends along the surface of the conveyor 15 from the edge of the conveyor remote from the grid 39 generally toward the opposite edge of the conveyor at an appropriate incline so as to gradually guide the article 13 against the peripheral surface 49. The guide 63 may be fixedly mounted as by supports 67 mounted adjacent the conveyor 15 or on the usual fixed portions of the conveyor.

Figure 6:
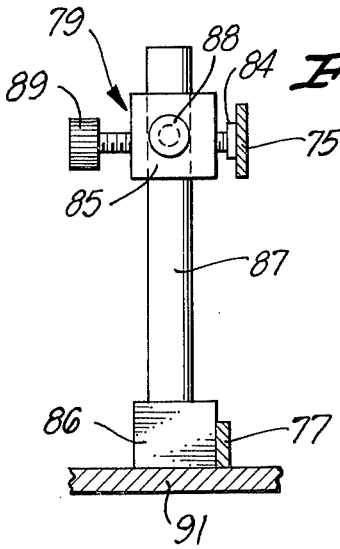
FIG. 6 is an enlarged side elevational view of one of the mounts for the guides.

The guide 65 includes a central section 69 which is curved to form a portion of a circle concentric with the cylindrical peripheral surface 49 and opposite end sections 71 and 73 which are inclined away from the conveyor 15. Although the guide 65 may be of various different constructions, it preferably includes an upper rail 75 and a lower rail 77 (FIGS. 5 and 6) which are spaced apart sufficiently to provide aperture means which permit the label on the grid 39 to be passed between such space in being transferred from the grid to the adjacent one of the articles 13. Each of the rails 75 and 77 is an elongated, flexible resilient strip.

Both of the rails 75 and 77 are mounted on identical mounts 79, and the opposite end portions of the rails 75 and 77 are held away from the conveyor 15 by fixed vertical rods 83. Each of the mounts 79 includes an upper block 85 and a lower block 86 mounted on a pair of vertical rods 87. The block 86 can be suitably fixed at the lower ends of the rods 87, and the block 85 is mounted for vertical sliding movement on the rods 87. The position of the block 85 along the rods can be adjusted by a set screw 88. A screw 89 is threaded into and carried by the block 85, and the upper rail 75 is suitably mounted on the inner end of the screw by a bearing 84 which permits the screw to turn relative to the upper rail. Accordingly, the screw 89 can be used to move the upper rail toward and away from the wheel 47 so that the guide 65 can be used for articles which have tapered side walls. The lower rail 77 is suitably affixed to the lower block 86. Of course, the specific construction of the guide 65, although preferred, is merely illustrative of one form of device which can be utilized for cooperating with the wheel 47 to hold the articles snugly against the peripheral surface 49.

The wheel 47 and the guide 65 cooperate to move the articles 13 laterally off of the conveyor 15 to a labeling station closely adjacent the grid 39. A horizontal plate 91 is provided between the conveyor 15 and the grid 39 at approximately the same elevation as the conveyor to support the articles 13 when they are removed from the conveyor. The plate 91 has an aperture 93 extending completely through it to permit labels to be applied to the bottoms of the articles 13 by another labeling means (not shown). The plate 91 can be supported in various different ways and, in the embodiment illustrated, it is mounted on the supporting structure 21.

With the components of the label applicator 11 arranged as shown in the drawing, the curved central region 69 of the guide 65 is centered on the grid 39 and is closely adjacent the grid. In the embodiment illustrated, the wheel 47 is mounted so that a radial line through the wheel 47 can be drawn perpendicular to the plane of the grid 39. The conveyor 15 moves the articles 13 horizontally past the label applicator 11 from right to left as viewed in FIG. 2. The peeling bar 33 is located at the downstream edge of the grid 39. The wheel 47 is sized and positioned so that a portion of the peripheral surface 49 is horizontally displaced from the conveyor 15.

In use, the guide 63 guides the articles 13 on the conveyor 15 against the peripheral surface 49 of the wheel 47 and against the central section 69 of the guide 65. This urges the article 13 against the resiliently deformable peripheral surface 49 to deform the wheel 47 radially inwardly to define a pocket 95 in which a portion of one side of the article 13 is received. In this manner, the article is captured and held in a predetermined orientation between the wheel 47 and the guide 65.

The wheel 47 rotates counterclockwise as viewed in FIG. 2 to move the articles 13 in the same general direction as the direction of movement of the conveyor 15. The articles 13 are captured between the wheel 47 and the guide 65 and are moved along an arcuate path 97 generally conforming to the configuration of the central section 69 from an inlet 99 to an outlet 101. This moves the articles 13 laterally off of the conveyor 15 and toward the grid 39. The approaching article 13 is sensed by the product sensor 43 which signals the labeling means 17 to dispense a label at the instant at which such article is directly confronting and centered on the grid 39. Because the article is captured, its orientation relative to the label on the grid is accurately known and controlled. Thereafter, the guide 65 and the wheel 47 cooperate to return the labeled article 13 to the conveyor 15.

The motor 61 rotates the wheel 47 at a known velocity so that the timing of the labeling function by the labeling means 17 is easily and accurately carried out. The wheel 47 can be driven at any speed compatible with the labeling means 17. If the articles 13 are temporarily supplied by the conveyor 15 faster than they can be labeled, they merely stack up adjacent the inlet 99 to the path 97, and there is no need to shut down the conveyor.

The labeling means 17 can label one side and the bottom of the articles 13. If it is desired to label the other side of the articles 13, another label applicator identical to the label applicator 11 is provided along the conveyor 15. The only difference is that this second label applicator would be located on the opposite side of the conveyor, i.e., it would be rotated 180 degrees, and the wheel 47 is appropriately positioned to allow labeling of the other side of the articles 13.

Although an exemplary embodiment of the invention has been shown and described, many changes, modifications and substitutions may be made by one having ordinary skill in the art without necessarily departing from the spirit and scope of this invention.

We claim:

1. A label applicator for labeling articles which are moved along a path by a conveyor, said label applicator comprising:

a wheel having a peripheral surface, at least a portion of said peripheral surface being resiliently deformable;

means for mounting said wheel for rotation about a rotational axis which extends generally transverse to the direction of movement of the conveyor adjacent said wheel, said wheel lying at least partially in the path of the articles conveyed to the wheel by the conveyor;

motor means for rotating said wheel about said rotational axis;

guide means adjacent said peripheral surface of said wheel for urging articles conveyed to the peripheral surface of said wheel against the peripheral surface to resiliently deform the peripheral surface sufficiently to capture the article and hold the article in a predetermined orientation whereby the articles are captured between the guide means and the wheel and held in a predetermined orientation; and labeling means for applying a label to each of the articles when each of said articles is held in said predetermined orientation.

2. A label applicator as defined in claim 1 wherein said path adjacent said label applicator is generally horizontal and said rotational axis extends generally vertically.

3. A label applicator as defined in claim 2 wherein at least a portion of said peripheral surface is horizontally displaced from the conveyor and said wheel and said guide means cooperate to laterally remove the articles from the conveyor and to return the articles to the conveyor, said labeling means applies the labels to the articles while such articles are removed from the conveyor.

4. A label applicator as defined in claim 1 wherein said peripheral surface is curved and said guide means includes a curved rail adjacent said peripheral surface of said wheel, said articles being held in said predetermined orientation between said curved rail and the peripheral surface.

5. A label applicator as defined in claim 4 wherein at least a portion of said peripheral surface is horizontally displaced from the conveyor and said wheel and said guide means cooperate to laterally remove the articles from the conveyor and to return the articles to the conveyor, said labeling means applies the labels to the articles while such articles are removed from the conveyor.

6. A label applicator as defined in claim 1 including article sensing means for providing a signal when one of the articles is captured by the wheel and the guide means and when such captured article reaches a predetermined position, and said labeling means includes means responsive to said signal for applying a label to such captured article.

7. A label applicator as defined in claim 6 wherein at least a portion of said peripheral surface is horizontally displaced from the conveyor and said wheel and said guide means cooperate to laterally remove the articles from the conveyor and to return the articles to the conveyor, said labeling means applies the labels to the articles while such articles are removed from the conveyor, said peripheral surface is curved and said guide means includes a curved rail adjacent said peripheral surface of said wheel, said articles being held in said predetermined orientation between said curved rail and the peripheral surface.

8. A label applicator for labeling articles which are moved past a labeling station, said label applicator comprising:

orienting means for guiding the articles along a predetermined path and for retaining said articles in a predetermined angular orientation as the articles are moved through said path, said path passing through the labeling station;

labeling means for applying labels to the articles at the labeling station while such articles are held in said predetermined orientation;

said orienting means including first means for engaging the articles on at least one side thereof, said first means having a resilient, deformable surface and means for mounting said first means for movement along said path at the labeling station; and said orienting means including means cooperable with the first means for engaging the articles on at least the other side thereof to urge the articles against the resilient deformable surface and into said resilient, deformable surface sufficiently to capture the article and hold the article in said predetermined orientation as such articles move through the labeling station.

9. A label applicator as defined in claim 8 wherein the articles are moved by a conveyor and said first means and said cooperable means remove the articles from the conveyor and return the articles to the conveyor and said labeling means applies the labels to the articles while such articles are removed from the conveyor.

10. A label applicator as defined in claim 9 wherein the articles are moved laterally off the conveyor by said first means and said cooperable means, said label applicator includes a platform adjacent the conveyor at the location where the articles are moved laterally off the conveyor and the articles are moved over said platform.

11. A label applicator as defined in claim 10 wherein said platform has aperture means and said labeling means includes means for applying at least some of the labels to the bottoms of the articles through said aperture means.

12. A label applicator as defined in claim 8 wherein said cooperable means includes a first rail and means for mounting the first rail for engagement with said other side of the articles.

13. A label applicator as defined in claim 8 wherein said cooperable means has aperture means and said labeling means includes means for blowing at least some of the labels through said aperture means to the articles.

14. A label applicator as defined in claim 8 including article sensing means for providing a signal when one of the articles is captured by said first means and said cooperable means and when such captured article reaches a predetermined position along said path, and said labeling means includes means responsive to said signal for applying a label to such captured article.

15. A label applicator as defined in claim 8 wherein said first means includes a wheel having a peripheral surface with at least a portion of the peripheral surface of said wheel being resiliently deformable, said mounting means includes means for mounting said wheel for rotation about a rotational axis which extends generally transverse to the direction of movement of the articles along said path.

16. A label applicator as defined in claim 8 wherein said cooperable means includes a first curved rail and means for mounting the first rail for engagement with said other side of the articles, said label applicator including article sensing means for providing a signal when one of the articles is captured by said first means and said cooperable means and when said captured article reaches a predetermined position along said path, and said labeling means includes means response to said signal for applying a label to such captured article.

* * * * *